US005713102A

United States Patent [19]

Schmitzer et al.

[11] Patent Number: 5,713,102

[45] Date of Patent: Feb. 3, 1998

[54] APPARATUS FOR DRY CLEANING EXPOSED FILMS

[75] Inventors: Andreas Schmitzer, Rebenweg 41, D-93309 Kelheim; Ingrid Manewald, Abensberg, both of Germany

[73] Assignee: Andreas Schmitzer, Kelheim, Germany

[21] Appl. No.: 641,829

[22] Filed: May 2, 1996

[30] Foreign Application Priority Data

May 5, 1995 [EP] European Pat. Off. ..... 95106858

[51] Int. Cl.[6] ..... B08B 5/04; B08B 6/00

[52] U.S. Cl. ..... 15/308; 15/1.51; 15/309.1

[58] Field of Search ..... 15/308, 306.1, 15/309.1, 1.51

[56] References Cited

U.S. PATENT DOCUMENTS

| | | | |
|---|---|---|---|
| 2,956,300 | 10/1960 | Bruno | 15/309.1 |
| 3,266,196 | 8/1966 | Barcard | 15/309.1 X |
| 3,531,201 | 9/1970 | Prentice | 15/308 X |
| 4,148,570 | 4/1979 | Ichiyanagi . | |
| 4,244,078 | 1/1981 | Hughes et al. | 15/309.1 X |
| 4,454,621 | 6/1984 | Testone | 15/309.1 X |
| 4,656,530 | 4/1987 | Farrow et al. . | |
| 5,349,713 | 9/1994 | Stimpfl | 15/309.1 X |

FOREIGN PATENT DOCUMENTS

9319373 U 9/1994 Germany .

*Primary Examiner*—Chris K. Moore
*Attorney, Agent, or Firm*—Spencer & Frank

[57] ABSTRACT

An apparatus for cleaning exposed film includes a dry cleaning unit including at least a first dry cleaning station comprising an ionization unit having an electrostatic discharge device and means for removing discharged dust particles from the film. A roller driven by a drive motor draws the film from an unwinding reel through the dry cleaning unit. A film take-up reel driven by a controlled drive motor is disposed downstream of the driven roller. The controlled drive motor is controlled so that a tensile force acting on the film remains uniform as a diameter of the film winding on the film take-up reel varies. A satisfactory cleaning of the film is thus achieved, even when cleaning old and heavily-soiled films, together with a reliable take-up of the cleaned film without a danger of film breakage in the film cleaning apparatus.

10 Claims, 4 Drawing Sheets

APPARATUS FOR DRY CLEANING EXPOSED FILMS

CROSS-REFERENCE TO RELATED APPLICATIONS

This application claims the right of priority with respect to application Ser. No. EP 951 068 58.4 filed on May 5, 1995, in the European Patent Office, the disclosure of which is incorporated herein by reference.

BACKGROUND OF THE INVENTION

The invention relates to a film cleaning apparatus for cleaning exposed film, and in particular to such a film cleaning apparatus which includes a dry cleaning station, a rotatable shaft driven by a drive motor for drawing the film from an unwinding reel through the dry cleaning unit, and a film take-up reel driven by a controlled drive motor and disposed downstream of the rotatable shaft. This type of film cleaning apparatus is disclosed in German Utility Patent DE-9 319 373.

To clean exposed, more or less heavily soiled films, it is known from DE-9 319 373 to first draw the film through an immersion bath in order to loosen a large portion of the adhering dirt. The film is subsequently dried by hot air and then subjected to an electrostatic cleaning, during which the dust particles adhering loosely due to the electrostatic charge are discharged and brushed off. A further dry cleaning step utilizing rolls of gummed tape follows the electrostatic dry cleaning. The gummed surfaces of these rolls remove the remaining dust and dirt particles from the surface of the film.

It has been observed in experiments, however, that the dirt is not loosened, but rather is only smeared in the immersion bath. The resulting smeared dirt layer cannot be removed in the subsequent dry cleaning steps. The above cited German utility patent suggests refraining from drying the film following an immersion bath cleaning. However, this suggestion only concerns lightly soiled films.

The known film cleaning apparatus has other problems as well, specifically take-up problems. One source of take-up problems is due to the sole film feed being provided by a capstan roller. The tensile force acting on the film varies as a function of the changing frictional value between the film surface and the capstan roller. With a dry, or less-soiled film surface, this frictional value is greater than with a damp or more heavily soiled film surface. Additionally, an rpm controlled electric drive for the take-up reel is provided in the known film cleaning apparatus. However, this drive is only operated in order to rewind the film.

SUMMARY OF THE INVENTION

It is an object of the invention to improve a film cleaning apparatus of the type mentioned at the outset so that reliable take-up of the cleaned film is assured along with a satisfactory cleaning effect.

The above and other objects are accomplished in accordance with the invention by the provision of an apparatus for cleaning exposed film, comprising: a dry cleaning unit including at least a first dry cleaning station comprising an ionization unit including an electrostatic discharge device and means for removing discharged dust particles from the film; a drive motor; a roller driven by the drive motor for drawing the film from an unwinding reel through the dry cleaning unit; a controlled drive motor; a film take-up reel driven by the controlled drive motor and disposed downstream of the driven roller; and means for controlling the controlled drive motor so that a tensile force acting on the film remains uniform as a diameter of the film winding on the film take-up reel varies.

The invention is primarily based on the realization that sufficient cleaning, even of heavily soiled films, is possible exclusively through dry cleaning. For heavily soiled films, two dry cleaning stations, known per se, are disposed one behind the other in the form of electrostatic and adhesion cleaning stations. Electrostatic cleaning suffices for lightly soiled films. For this purpose, the second dry cleaning station can be bypassed with the use of a shunt roller.

Although the frictional value of the film surface fluctuates less when a wet cleaning step is eliminated than when a prior wet cleaning and subsequent film drying are employed, it has been shown that the sole feed of the film by a capstan roller is not sufficient to bring take-up problems associated with film breaks under control. Therefore, the invention provides continuous control of the drive of the take-up reel, not only for rewinding the film, but also during the cleaning process, so that the tensile force exerted on the film remains uniform as the diameter of the film winding on the take-up reel varies over the entire diameter of the take-up reel. This means that the rpm of the controlled drive motor is reduced as the diameter of the wound film on the take-up reel increases. As a consequence of the constant tensile force, the chance of a break in the film during cleaning is substantially reduced.

For historically valuable films, of which often only a few, mostly heavily-soiled copies still exist, changes in tensile force due to reductions in film elasticity caused by aging would be particularly critical, and could lead to breaks in film, frequently with irreparable damage. Nevertheless, should a break occur in the film, the provision of a limit switch according to another aspect of the invention ensures that the break is automatically detected, and the film feed drives are deactivated.

According to another feature of the invention, a further evening out of the tensile force exerted on the film can preferably be achieved by the provision of two deflection rollers disposed upstream of the capstan roller (driven roller). These rollers assure a sufficient film wrap by the capstan roller, thus minimizing the slip between the film and the capstan roller.

The invention is explained in detail by way of an embodiment illustrated in the drawings.

DETAILED DESCRIPTION OF THE PREFERRED EMBODIMENTS

Figure 2:
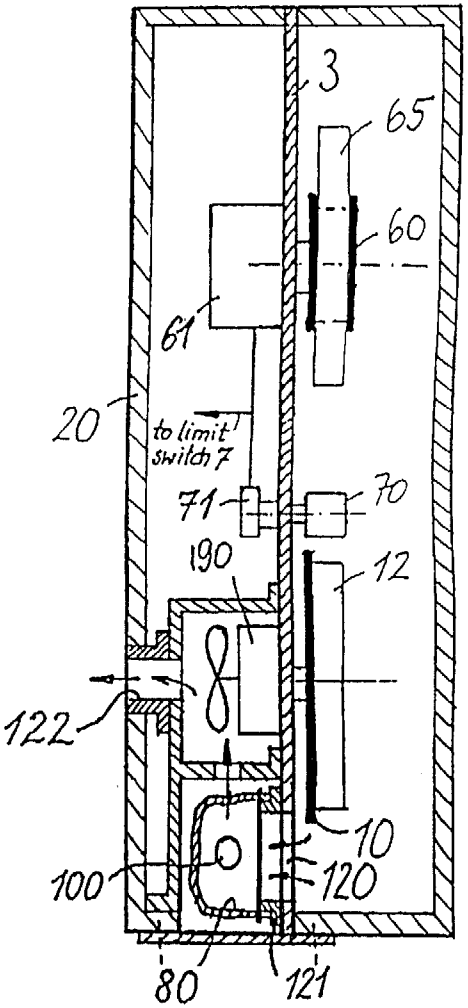
FIG. 2 shows a schematic view of the unwinding and take-up reels, and of the film feed of the apparatus of the invention, rotated by 90° with respect to FIG. 1.
Figure 1:
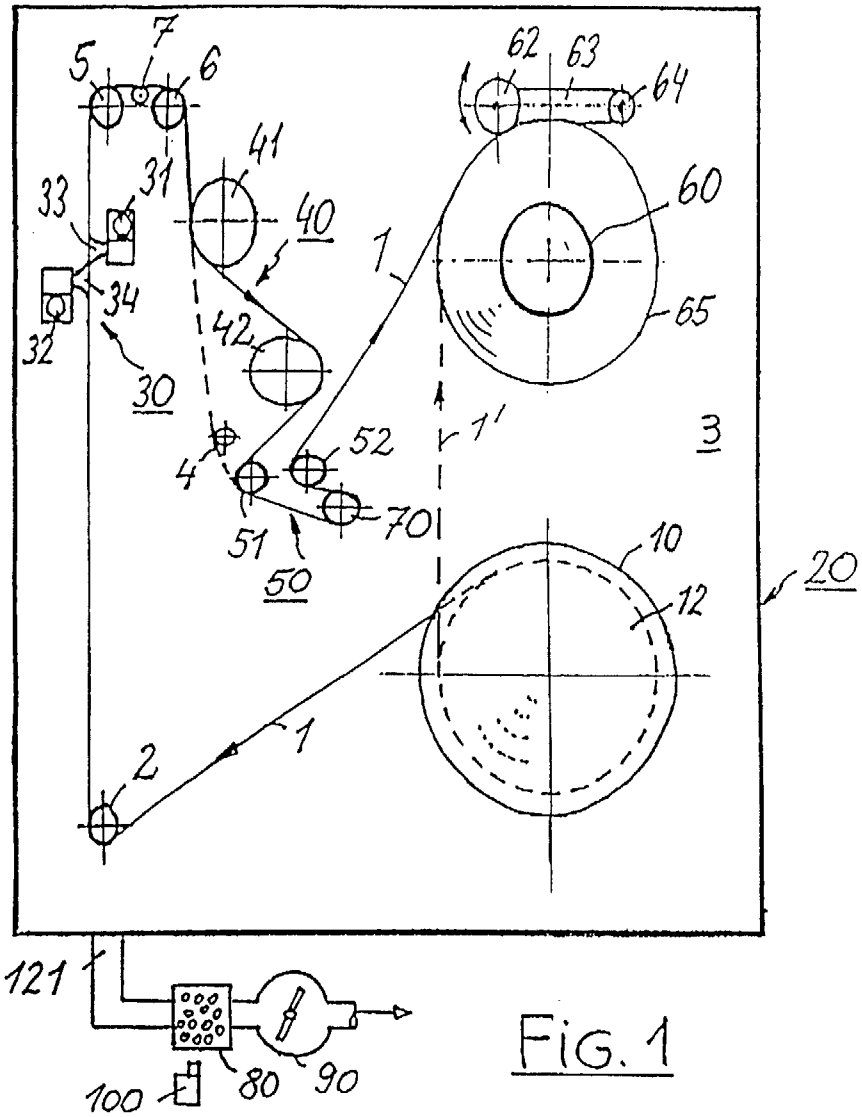
FIG. 1 shows a schematic side view of an embodiment of a film cleaning apparatus according to the invention.

A film cleaning apparatus according to the invention is illustrated in a schematic side view in FIG. 1. The film cleaning apparatus is used for an exposed film 1, particularly cinematic film, and has a closed housing 20 with a mounting plate 3, which is mounted in the vertical direction, parallel to the plane of the drawing and which subdivides housing 20 in the manner of a partition as shown in FIG. 2. The components of the apparatus accommodated in housing 20 are secured to mounting plate 3.

An unwinding reel 10 is disposed in a region of the lower section of mounting plate 3. Unwinding reel 10 is seated to rotate freely and is provided with a roller brake, not shown, so that the film winding 12 wound onto roller 10 must be unwound with a defined tensile force. As will be explained in detail, this tensile force is jointly applied by a drive motor 71 of a capstan roller 70 and the drive motor 61 of a take-up reel 60. Take-up reel 60 is disposed vertically above unwinding reel 10, which has the advantage that the cleaning apparatus can additionally be used to rewind film 1 (indicated by 1' in this mode of operation). The film strip to be rewound is indicated by a dashed line in FIG. 1.

For cleaning, the film is guided from unwinding reel 10, via a deflection roller 2, vertically upwardly in a film guidance plane that coincides with the drawing plane of FIG. 1, to a first dry cleaning station 30 configured as an ionization device. The ionization device includes, in a known manner, two rod-shaped discharge devices 31, 32 disposed adjacent opposite film surfaces and electrically supplied by a common high voltage power supply. The ions sprayed on by discharge devices 31, 32 neutralize the electrical charges present on the film surfaces. During further transport of film 1, dust and dirt particles on the film surfaces that have been discharged in this manner are brushed off with the aid of soft hairbrushes 33, 34, which are oriented against the two film surfaces.

To prevent the brushed off dirt and dust particles from settling at another location on film 1 inside housing 20, an exhaust opening 120 (see FIG. 2) is provided on mounting plate 3 in a region of the bottom side of the housing 20. This exhaust opening, which is secured by a screen or pad, has an exhaust connection 121 flanged to it. Exhaust connection 121 leads to a dust filter 80 which is charged with a vacuum by an exhaust fan 90. Exhaust fan 90 is connected to ambient air via an opening 122 in the wall of the housing 20. Contrary to the schematic representation in FIG. 1, units 80 and 90 may be located inside of closed housing 20, on the same side of mounting plate 20 as drive motors 61 and 71.

Figure 6:
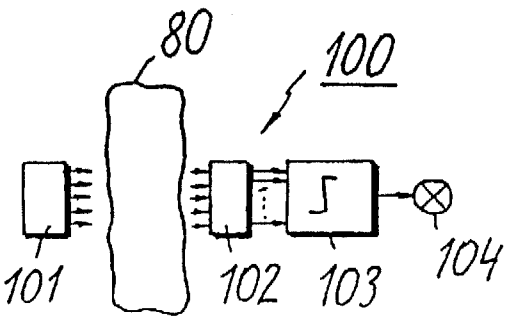
FIG. 6 is a schematic showing details of sensor 100 shown in FIG. 1.

The degree of soiling of dust filter 80, which can be configured as a vacuum cleaner bag, is monitored by a sensor 100 and signalized visually. In this regard, it can be seen from FIG. 6 that sensor 100 is comprised of, for example, a light barrier with a diffusely radiating light source 101 and a photodiode array 102. Dust filter 80, made of transparent plastic, is arranged between light source 101 and photodiode array 102. The photocurrents of all photocells of the photodiode array 102 are added up in a summing device 103 and the resulting composite signal is compared to a set threshold value. If the composite signal falls short of the set threshold value due to increasing soiling of the dust filter 80, summing device 103 generates a display signal at its output which is supplied to a warning light 104 and causes light 104 to light up.

After passing through the first dry cleaning station 30, film 1 is reversed by approximately 180° in its direction of travel by means of two further deflection rollers 5, 6, and fed to a second dry cleaning station 40. A limit switch 7, which is in constant contact with film 1, is located between deflection rollers 5, 6 for detecting a break in the film and supplying a corresponding sensor signal to drive motors 61 and 71 as schematically shown in FIG. 2. Drive motors 61 and 71 are immediately stopped when a break is detected, so that film transport by means of capstan roller 70 and take-up reel 60 is halted.

In the illustrated example, the second dry cleaning station 40 comprises two rollers 41, 42 of gummed tape that respectively engage a film surface. The adhesive layer on the surface of gummed rollers 41, 42, which must be changed from time to time, removes remaining dust and dirt particles from the two film surfaces by means of its adhesive effect. Instead of gummed rollers, rollers having a dielectric surface material can be used. These remove the remaining dust and dirt particles from the two film surfaces by means of an electrostatic charge.

For merely lightly soiled films 1, it can suffice to conduct film only through the first dry cleaning station 30. In this case, film 1 is guided directly to a further deflection roller 51 via a shunt roller 4, bypassing gummed rollers 41, 42. Deflection roller 51 is disposed behind second gummed roller 42 and, together with a further deflection roller 52, forms a wrap roller pair 50. Capstan rikker 70 is disposed behind roller 51 and in front of roller 52. Wrap roller pair 50 ensures, on the one hand, that film 1 rests on the frictional surface of the capstan roller over a circumferential angle of more than 180°. On the other hand, film 1 is tensed by the wrap effect of all three rollers 51, 70 and 52, which minimizes the slip between film 1 and the frictional surface of roller 70. After passing wrap roller pair 50, film 1 is fed to take-up reel 60 as film winding 65. For exact film guidance, film winding 65 is acted upon in the radial direction by a pressing force of a pressing roller 62. Pressing roller 62 is seated to rotate freely on a pivot arm 63, which can pivot about a pivot axis 64, if necessary under the prestress force of a spring, not shown.

Figure 3:
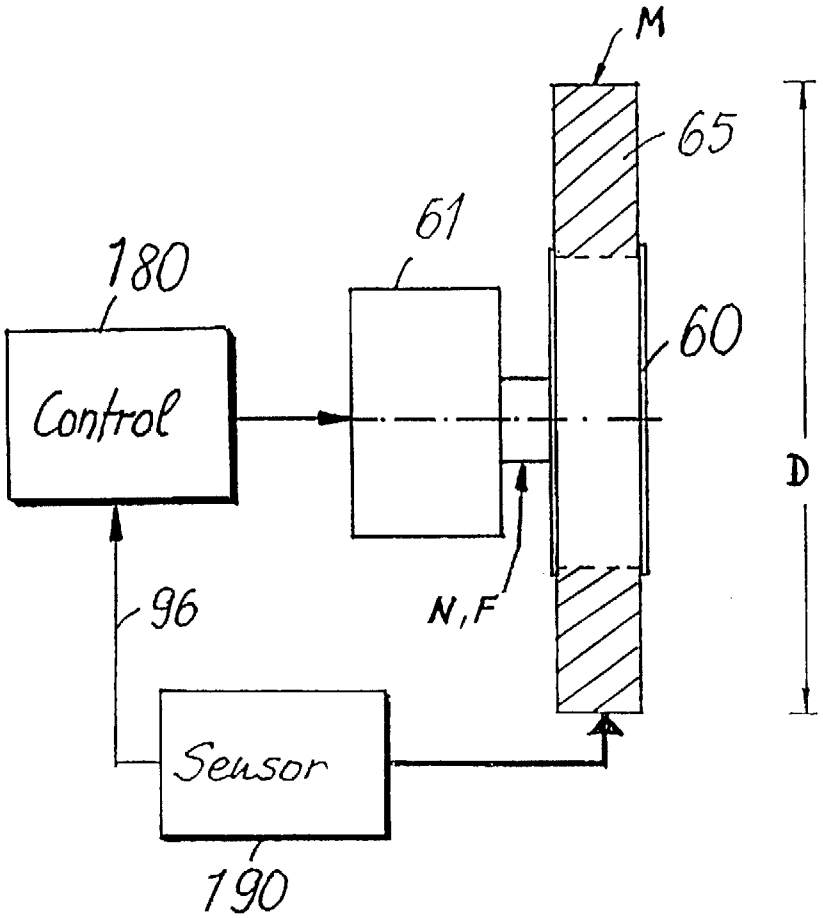
FIG. 3 is a block circuit diagram showing a control circuit for the drive roller shown in FIG. 1.

Referring now to FIG. 3, drive motor 61 is controlled with regard to its rpm by a control 180 such that the tensile force or torque exerted on film 1 by drive roller 60 remains uniform and constant over the entire diameter of film winding 65. Without this type of tensile force control, the tensile force would increase accordingly with the increasing diameter of film winding 65, which would be tantamount to an increase in the risk of film breakage.

The films 1 to be cleaned are often very old, and correspondingly dirty, films whose original elasticity and tensile strength are greatly reduced due to aging of the film material and numerous splices. For controlling the tensile force applied to film winding 65, the diameter D of film winding 65 is scanned by a sensor 190 and converted into an electrical measuring signal 196, as can be further seen from FIG. 4. Measuring signal 196 is supplied to electronic control 180. As a function of the momentary value of the measuring signal 196, control 180 changes the rpm N of drive motor 61 and thus its driving force F. The torque M acting on the outer circumference of the film winding 65 is a result of the product $F \times D \times 0.5$, which must be kept constant so that the tensile force acting on the film remains constant. This means that the driving force F and the rpm N of drive motor 61, which is proportional to the driving force F, must be controlled inversely proportional to the measured diameter D of film winding 65 to ensure that the torque M remains constant.

Figure 4:
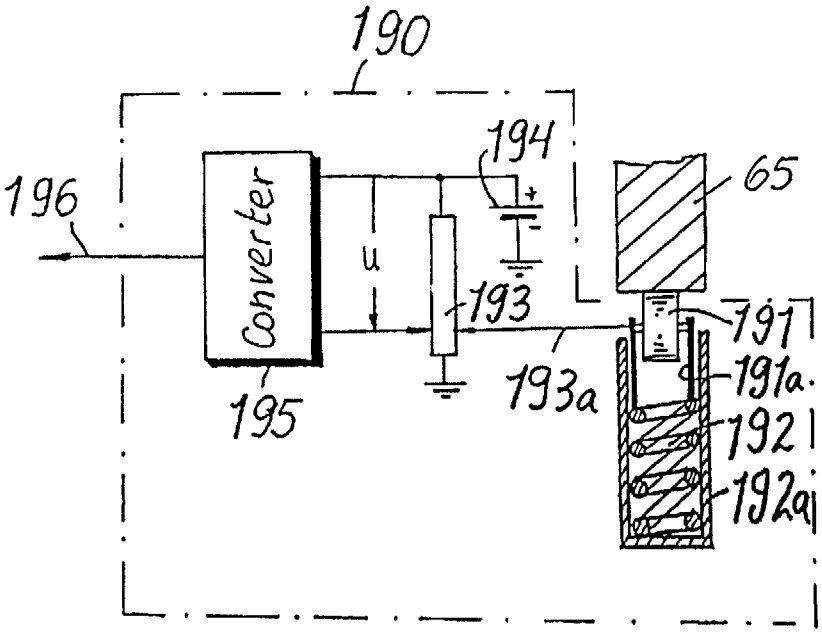
FIG. 4 is a schematic showing details of an embodiment of sensor 190 of FIGS. 1 and 3.

As can be seen from FIG. 4, the scanning of diameter D by sensor 190 can take place by means of a small feeler roller 191 which is pressed in a force-transmitting manner against the surface of film winding 65 by way of a pressure spring 192. Pressure spring 192 is guided in a sleeve 192*a* so as to be longitudinally displaceable and the spring is force-transmittingly connected via a fork 191*a* to the axel of the feeler roll 191, which axel is fixed against relative rotation. Thus, the momentary position of feeler roller 191, which can be displaced along the longitudinal axis of the sleeve 192*a*, with respect to an initial position (which corresponds to the minimum value of the diameter D) represents the momentary value of diameter D. The axle of feeler roller 191 is rigidly connected to a wiper 193*a* of a linear potentiometer 193 so that the momentary position of wiper 193*a* moved by feeler roller 191 also represents the momentary value of diameter D. The upper end of potentiometer 193 is connected to the positive pole of a d.c. voltage source 194, while the lower end of potentiometer 193 is at ground. The voltage U, which decreases between the upper end of potentiometer 193 and its wiper 193*a*, is a direct measure for the momentary value of diameter D of the film winding 65 and is used as measuring signal 196 after suitable conversion in a converter 195. The converter converts, for example, the voltage U into a pulse signal or into a digital signal, depending on the form in which the measuring signal 196 is needed by control 180 for further processing.

Figure 5:
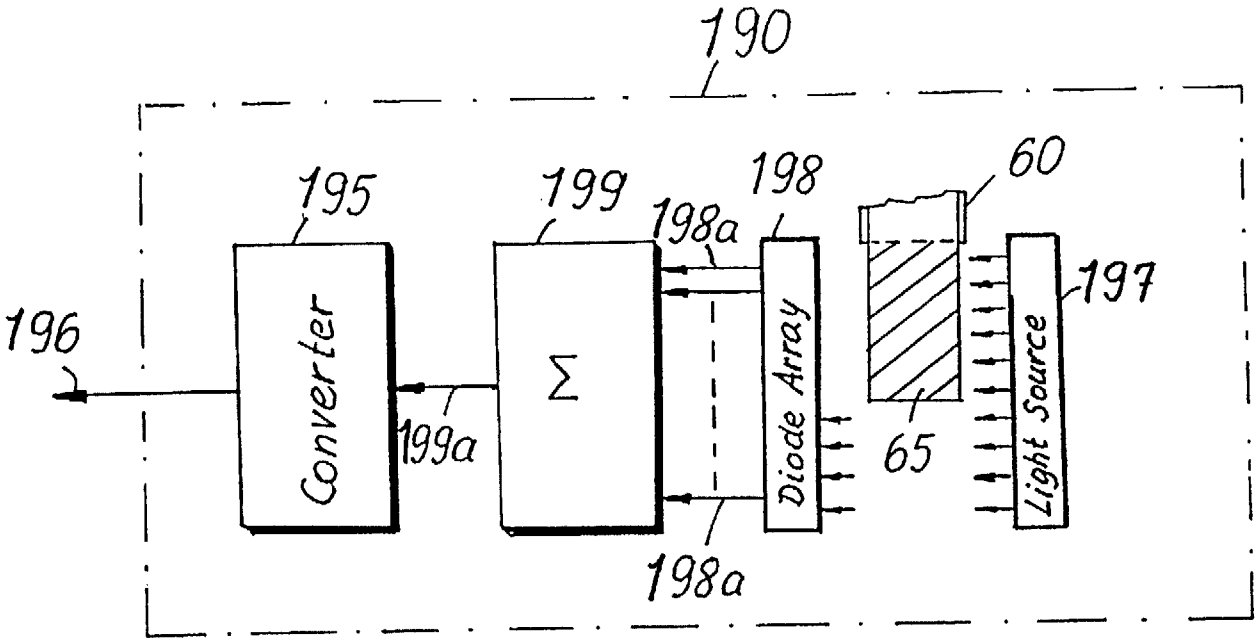
FIG. 5 is a schematic showing another embodiment for the sensor 190 of FIGS. 1 and 3.

In place of the mechanical-electrical measurement of diameter D shown in FIG. 4, diameter D of film winding 65 may also be scanned opto-electronically in the manner of a light barrier according to FIG. 5. During this process, film winding 65 is illuminated in the axial direction along its right flank by a band-shaped, diffusely radiating light source 197. A photodiode array 198 is arranged precisely opposite of light source 197 on the other side of film winding 65. Onto the photodiodes of the photodiode array falls that portion of the emitted light which is not covered or stopped down by film winding 65. The number of the illuminated photodiodes of photodiode array 198 increases linearly as the diameter of film winding 65 decreases. The photocurrents 198*a* of all photodiodes added up in a summing element 199 are inversely proportional with their sum value 199*a* to the momentary value of diameter D. The sum value 199*a*, in turn, is converted into measuring signal 196 by means of converter 195.

Old films, in particular, can be cleaned with the aid of the tensile force control of film winding 65 of the invention without the danger of breaks in film. In addition, the exclusive dry cleaning by dry cleaning stations 30 and 40 assures effective removal of all dirt and dust particles, on the one hand, and extremely gentle cleaning of the valuable film material on the other. In contrast to the wet cleaning mentioned at the outset and known from the prior art, in the cleaning apparatus of the invention, smearing of the dirt particles on the film's surface and a detachment of splices is completely ruled out.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. An apparatus for cleaning exposed film, comprising:

a dry cleaning unit including at least a first dry cleaning station comprising an ionization unit including an electrostatic discharge device and means for removing discharged dust particles from the film;

a drive motor;

a roller driven by the drive motor for drawing the film from an unwinding reel through the dry cleaning unit;

a controlled drive motor;

a film take-up reel driven by the controlled drive motor and disposed downstream of the driven roller; and means for controlling the drive motor so that a tensile force acting on the film remains uniform as a diameter of the film winding on the film take-up reel varies.

2. The apparatus as defined in claim 1, wherein the driven roller comprises a capstan roller.

3. The apparatus as defined in claim 1, wherein the driven roller comprises a sprocket wheel.

4. The apparatus as defined in claim 1, wherein the dry cleaning unit further comprises a second dry cleaning station disposed downstream of the first dry cleaning station for removing dirt and dust particles from opposing surfaces of the film by at least one of adhesion and electrostatic attraction.

5. The apparatus as defined in claim 4, further comprising a limit switch disposed along the film strip prior to the second dry cleaning station for detecting a break in the film, said limit switch being coupled to the drive motor and the controlled drive motor for deactivating said motors in response to a break in the film.

6. The apparatus as defined in claim 4, further comprising a shunt roller disposed between the second dry cleaning station and the driven roller so that the film can be guided to bypass the second dry cleaning station.

7. The apparatus as defined in claim 1, further comprising first and second deflection rollers disposed, respectively, in front of and behind the driven roller for wrapping the film around a significant portion of a circumference of the driven roller.

8. The apparatus as defined in claim 1, wherein the film take-up reel and the unwinding reel are disposed in a common plane so that the film can be rewound directly between said reels while bypassing the dry cleaning unit.

9. The apparatus as defined in claim 1, further comprising a housing enclosing at least the dry cleaning unit, and an exhaust device communicating with the inside of the housing and having an upstream dust filter for dirt and dust particles brushed off in the first dry cleaning station.

10. The apparatus as defined in claim 9, further comprising a sensor for detecting a degree of soiling of the dust filter and a display coupled to the sensor for displaying the degree of soiling.

* * * * *